US007011007B2

(12) United States Patent
Stein

(10) Patent No.: US 7,011,007 B2
(45) Date of Patent: Mar. 14, 2006

(54) APPARATUS FOR CUTTING AND CREATING NOTCHES AND APERTURES IN SHEET-TYPE WORK MATERIAL

(75) Inventor: Darryl C. Stein, Andover, CT (US)

(73) Assignee: Gerber Technology, Inc., Tolland, CT (US)

( * ) Notice: Subject to any disclaimer, the term of this patent is extended or adjusted under 35 U.S.C. 154(b) by 102 days.

(21) Appl. No.: 10/627,003

(22) Filed: Jul. 25, 2003

(65) Prior Publication Data

US 2004/0099116 A1 May 27, 2004

Related U.S. Application Data

(60) Provisional application No. 60/398,936, filed on Jul. 26, 2002.

(51) Int. Cl.
*B26D 1/18* (2006.01)
*B26D 5/08* (2006.01)

(52) U.S. Cl. ..... 83/552; 83/940; 83/954; 83/331; 83/663; 83/917; 83/671

(58) Field of Classification Search ..... 83/76.9, 83/332, 486.1, 671, 917, 954, 936, 940, 552, 83/451, 331, 343, 663
See application file for complete search history.

(56) References Cited

U.S. PATENT DOCUMENTS 3,522,753 A * 8/1970 Schmied ..... 83/471.2
3,566,932 A 3/1971 Papenmeier ..... 143/47
3,765,291 A 10/1973 Stenfeldt ..... 83/563
3,766,813 A 10/1973 Pearl ..... 83/56
3,816,904 A 6/1974 Herb ..... 29/568
3,852,144 A 12/1974 Parry ..... 156/510
4,060,016 A * 11/1977 Gerber ..... 83/451
4,228,710 A 10/1980 Karbowski ..... 83/794
4,313,478 A * 2/1982 Suzuki ..... 144/48.1
4,362,077 A * 12/1982 Gerber ..... 83/453
4,401,001 A * 8/1983 Gerber et al. ..... 83/451
4,448,808 A * 5/1984 Pearl ..... 427/208.6
4,462,292 A * 7/1984 Pearl ..... 83/471.2
5,775,189 A * 7/1998 Ikoma et al. ..... 83/76.1
6,152,003 A * 11/2000 Jung ..... 83/74
6,681,669 B1 * 1/2004 Bogan ..... 83/176

* cited by examiner

*Primary Examiner*—Boyer D. Ashley
(74) *Attorney, Agent, or Firm*—Morgan & Finnegan, LLP

(57) ABSTRACT

In an apparatus for cutting pattern pieces and creating apertures in sheet-type work material a frame has a support surface mounted thereon for carrying at least one layer of the work material. A carriage is coupled to the frame for movement back-and-forth there along a first coordinate direction in response to commands issued from a controller. A cutting head is mounted to the carriage and moves in a second coordinate direction along the carriage approximately perpendicular to the first coordinate direction. A rotary die is coupled to the cutting head and at least one cutting tool is mounted to the rotary die. The cutting tool includes a shaped cutting portion corresponding to the shape of an aperture to be formed in the work material. During operation the rotary die is movable between a working position wherein the cutting tool engages the work material and a non-working position wherein the rotary die is positioned away from the work material.

17 Claims, 5 Drawing Sheets

APPARATUS FOR CUTTING AND CREATING NOTCHES AND APERTURES IN SHEET-TYPE WORK MATERIAL

CROSS-REFERENCE TO RELATED APPLICATIONS

This application is entitled to the benefit of and incorporates by reference essential subject matter disclosed in Provisional Patent Application No. 60/398,936 filed on Jul. 26, 2002.

FIELD OF THE INVENTION

The present invention is generally directed to cutting and creating apertures such as notches in sheet type work material and is more specifically directed to simultaneously cutting an edge and generating notches and other shaped apertures.

BACKGROUND OF THE INVENTION

Pattern pieces cut from layers of sheet-type work material particularly those cut from leather hides often have apertures such as holes or notches cut therein. In many instances, these notches are cut into arcuate edges of the pattern piece. Historically, cutting these notched pattern pieces involved a two step process. Generally, the notches are first cut into the work material with a punch or a cutting blade, and then the edges of the pattern piece are cut typically using a wheel type cutter. Cutting the notches, particularly if there are many, is in and of itself a labor intensive, time consuming process. Following the notching step with the subsequent step of cutting the peripheral edges further increases the time required to cut the pattern piece from the work material.

Another difficulty occurs when a series of different notch patterns or differently shaped notches are required in the same pattern piece. When this occurs it is necessary to have on hand, and use several different notch cutting tools as well as to properly layout the notch pattern. These steps can greatly and detrimentally effect the amount of time it takes to cut a pattern piece from the work material. In addition, because of the requirement for multiple operations, the likelihood for errors to be made increases.

Based on the foregoing, it is the general object of the present invention to provide a notching and cutting apparatus that improves upon or overcomes the drawbacks of prior art devices.

SUMMARY OF THE INVENTION

The present invention is directed in one aspect to an apparatus for cutting pattern pieces in, and creating apertures in sheet-type work material wherein the apparatus includes a frame having a support surface mounted thereon for carrying at least one layer of the work material. A carriage is coupled to the frame for movement back-and-forth there along in a first coordinate direction in response to commands issued from a controller. A cutting head is mounted to the carriage for movement back-and-forth along the carriage in a second coordinate direction generally perpendicular to the first coordinate direction. A rotary die is rotatably coupled to the cutting head with at least one cutting tool coupled thereto. The cutting tool has a shaped cutting portion corresponding to the shape of an aperture to be formed in the work material. As used herein, the term "aperture" should be broadly construed to include both holes and edge notches. The rotary die is movable between a working position wherein the at least one cutting tool engages the work material, and a non-working position wherein the rotary die is positioned away from the work material. During operation when the rotary die is in the working position, shaped apertures are formed in the work material.

Preferably, a cutter is coupled to the cutting head for movement between a working position wherein the cutter engages the work material and a non-working position wherein the rotary die, and thereby the cutter is positioned away from the work material. In the preferred embodiment the cutter is positioned adjacent to the rotary die when each is in the working position, to allow pattern pieces to be simultaneously cut and notched in response to commands issued from the controller.

In the preferred embodiment of the present invention, the rotary die is coupled to an actuator that is positioned between the rotary die and the cutting head. The actuator is of a suitable type, such as, but not limited to a servo or stepper motor. The actuator selectively indexes the rotary die to position a cutting tool mounted thereon, in proximity to the work material. In addition, causing the die to roll along the work material will allow for patterns of spaced-apart apertures to be cut.

In an embodiment of the present invention, the rotary die is adapted to carry a plurality of cutting tools. In addition, each of the cutting tools can be pivotally coupled to the rotary die to allow a cutting portion defined by the die to rotate into or out of position as the rotary die is indexed. The cutting tools can be configured so that each cuts the same shaped aperture or different shaped apertures or a combination thereof. A tool changer can also be provided so that during operation, different cutting tools can be loaded onto or removed from the rotary die.

An advantage of the present invention is that the process of cutting apertures into the work material in predetermined patterns can be performed quickly and automatically.

Another advantage of the present invention is that a pattern piece can be simultaneously notched and the edges cut.

DETAILED DESCRIPTION OF THE PREFERRED EMBODIMENTS

Figure 1:
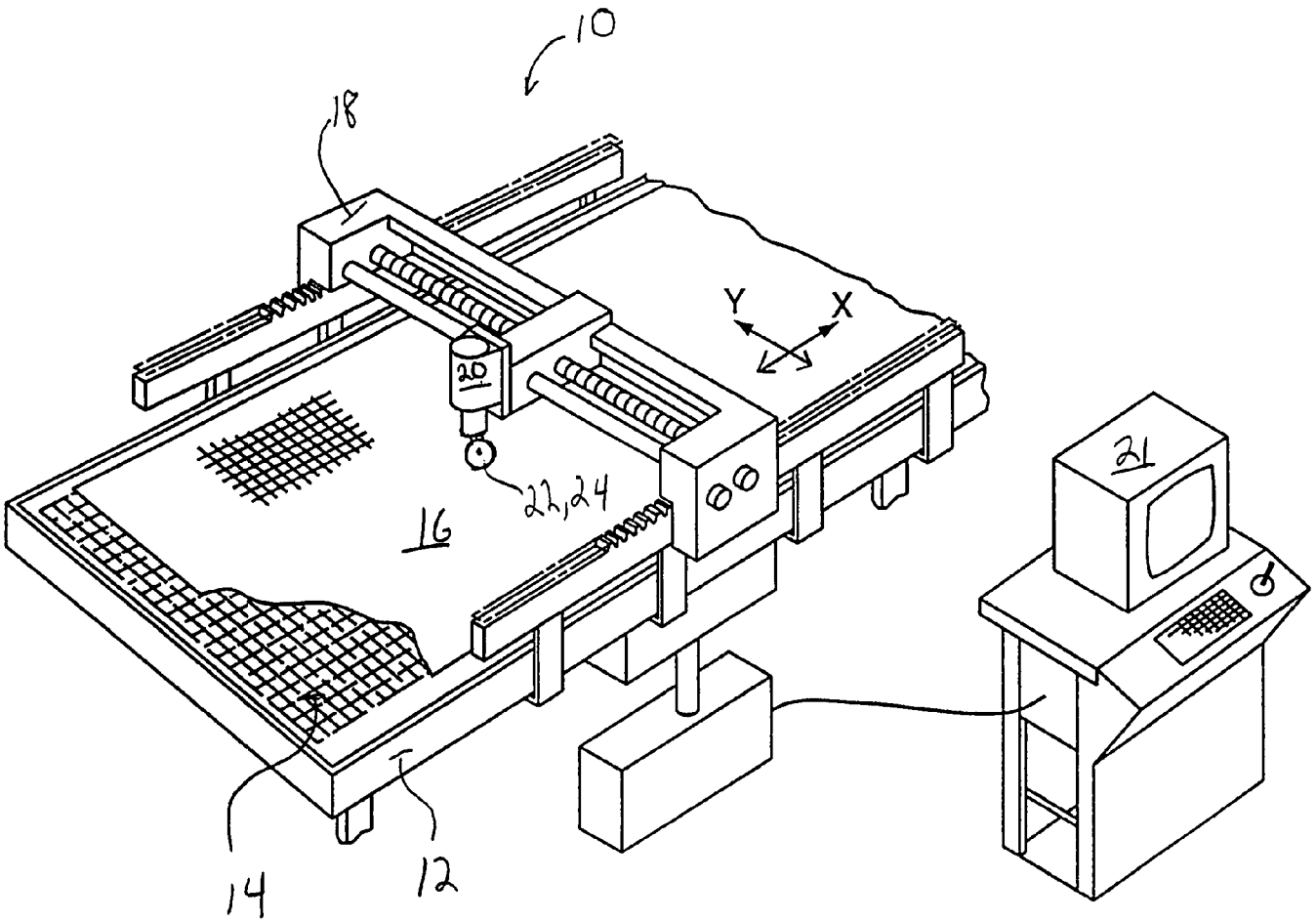
FIG. 1 is a partial schematic illustration of a cutting table incorporating the present invention.

As shown in FIG. 1, a cutting table generally designated by the reference number 10, includes a frame 12 and work material support surface 14 adapted to carry at least one layer of sheet-type work material 16, such as, but not limited to leather or vinyl thereon. A carriage 18 is coupled to the frame for movement back-and-forth in a first direction as indicated by the arrows labeled "X." A cutting head 20 is mounted on the carriage 18 and is movable back-and-forth therealong in a second direction as indicated by the arrows labeled "Y." Both the carriage 18 and the cutting head 20 move in response to commands issued from a controller 21. As will be explained in detail below, a pair of cutting tools, each for performing a different type of cutting operation, are mounted to the cutting head 20. The cutting tools are movable between a working position, wherein they engage the work material 16, and a non-working position wherein they are lifted off of the work material.

Figure 2:
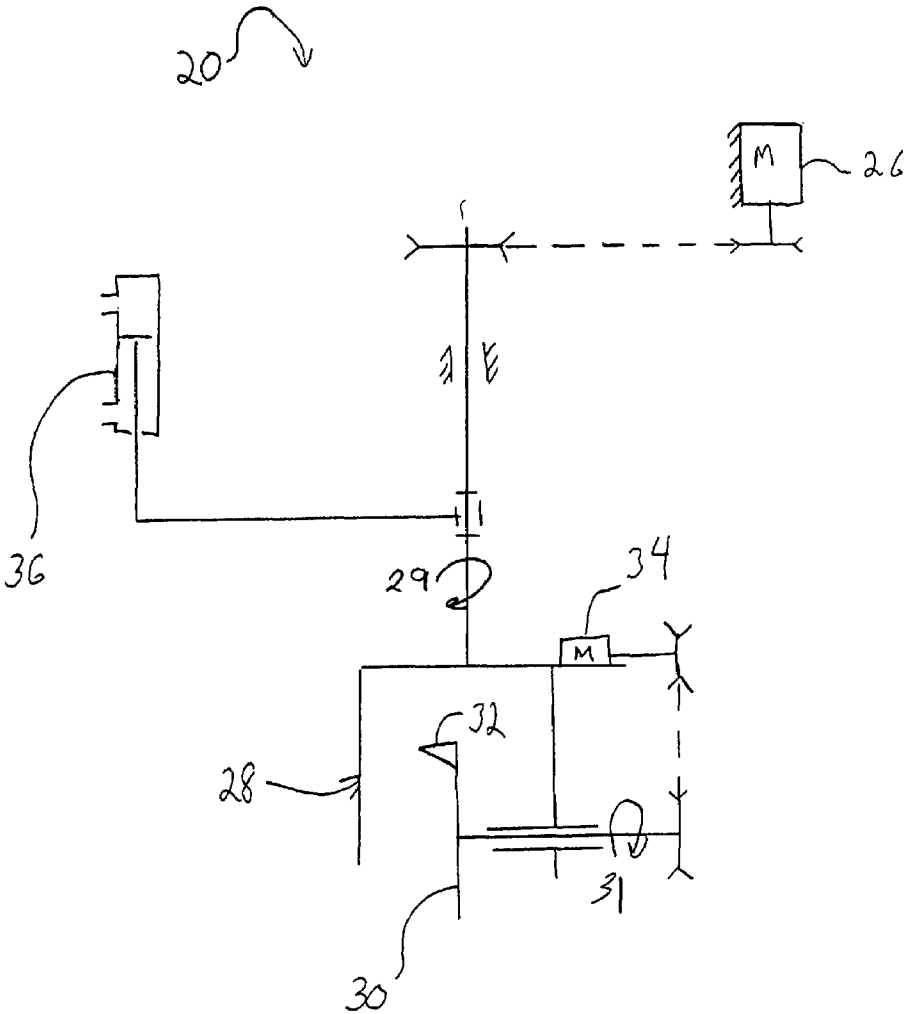
FIG. 2 schematically illustrates a rotary die coupled to a cutting head forming part of the cutting table of FIG. 1.

As shown schematically in FIG. 2, the cutting head 20 includes a suitable drive, such as a stepper motor 26 coupled to a housing 28. The housing 28 is rotatable about an axis designated by the reference number 29 by the stepper motor 26. The axis 29 is generally perpendicular to the axis 31 about which the rotary die 30 rotates. A rotary die 30 having at least one cutting tool 32 mounted thereon is rotatably coupled to the housing 28 and is driven by suitable means, such as, but not limited to a second stepper motor 34. An actuator 36 shown in the illustrated embodiment as a pneumatic cylinder is mounted to the cutting head 20 and coupled to the housing 28 to move the housing between the working and non-working positions. While first and second stepper motors, 26 and 34 respectively, have been shown and described, the present invention is not limited in this regard as other types of actuators known to those skilled in the pertinent art to which the present invention pertains, such as servos, can be substituted without departing from the broader aspects of the invention. The same is true for the pneumatic cylinder, other types of actuators such as stepper motors, servos, or hydraulic cylinders can be substituted.

Figure 4:
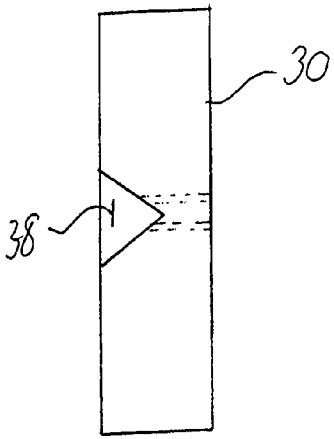
FIG. 4 is a side elevational view of the rotary die of FIG. 3.
Figure 5:
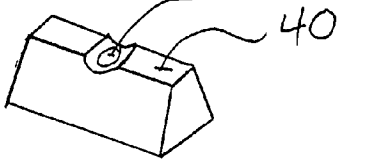
FIG. 5 is a perspective view of an embodiment of one type of cutting tool mountable on the rotary die of FIG. 3.
Figure 3:
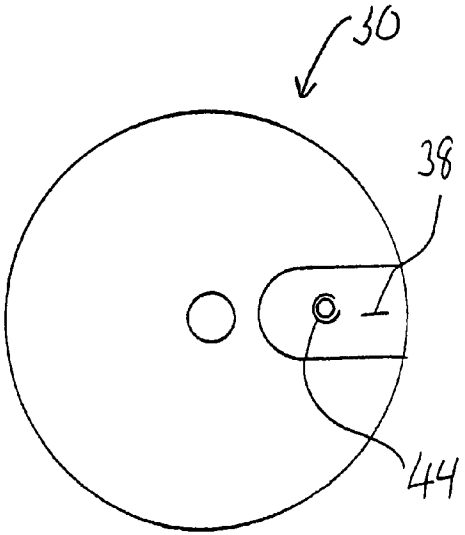
FIG. 3 is a front elevational view of an embodiment of a rotary die without a cutting tool mounted thereon.

As shown in FIGS. 3–5, the rotary die 30 includes a recessed section 38 into which a cutting tool 40 is mounted. The cutting tool 40 defines an aperture 42 extending therethrough. A fastener not shown extends through the aperture 42 and threadably engages a tapped hole 44 defined by the rotary die 30. While a fastener extending through the aperture 42 and engaging the tapped hole 44 has been described, the present invention is not limited in this regard as other mounting means, such as a taper lock, ball and detent, or snap fit can be employed without departing from the broader aspects of the present invention. In addition, while a cutting tool 40 has been shown and described, the present invention is not limited in this regard as other types of tools such as a punch can be substituted without departing from the broader aspects of the present invention.

During operation, and in response to command signals issued from the controller 21, the rotary die 30 is moved to a position where a notch or aperture is to be cut, the rotary die is indexed to position the cutting tool 32 over the work material 16. The cutting tool 32 is then brought into engagement with the work material 16 and a notch or other shaped aperture is cut.

Figure 6:
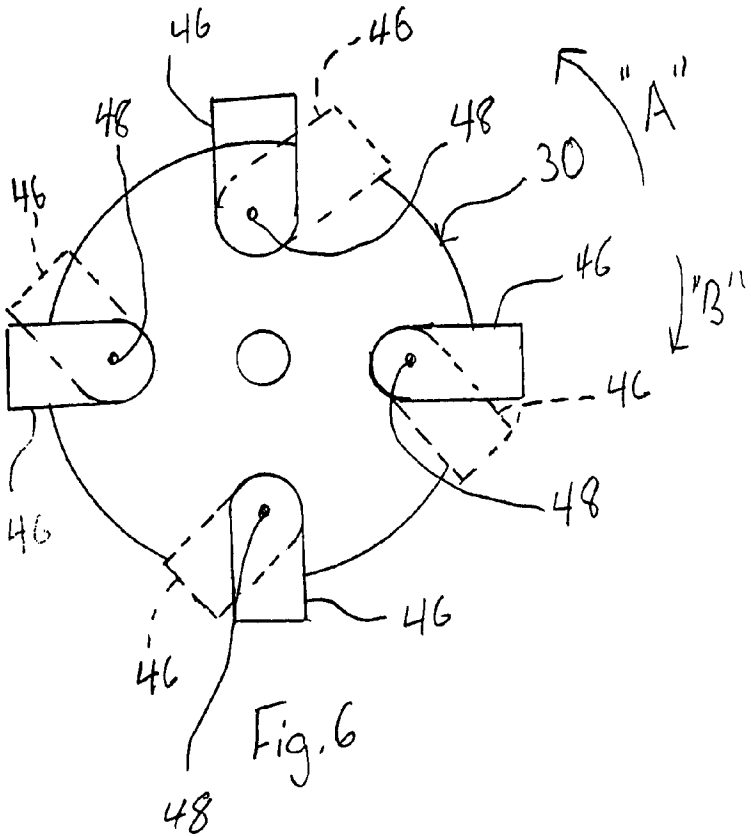
FIG. 6 is a partial schematic illustration of a multiple cutting tool attached to the rotary die.

As shown in FIG. 6, the rotary die 30 can be configured to accommodate multiple cutting tools 32. In the illustrated embodiment four tool holders 46 are mounted for pivotal movement about a pivot axis 48. The tool holders 46 move to the rotated position (shown in dotted lines) when the rotary die 30 is rotated in the direction indicated by the arrow labeled "A." When the rotary die 30 is rotated in the direction labeled "B", generally opposite the "A" direction, the tool holder 46 closest to the work material moves into cutting position so that a cutting tool mounted thereon can be employed. While the directions "A" and "B" are shown in the illustrated embodiment as counter-clockwise and clockwise respectively, the present invention is not limited in this regard as the tool holders 46 can be configured to function opposite to the above-described manner.

Figure 7:
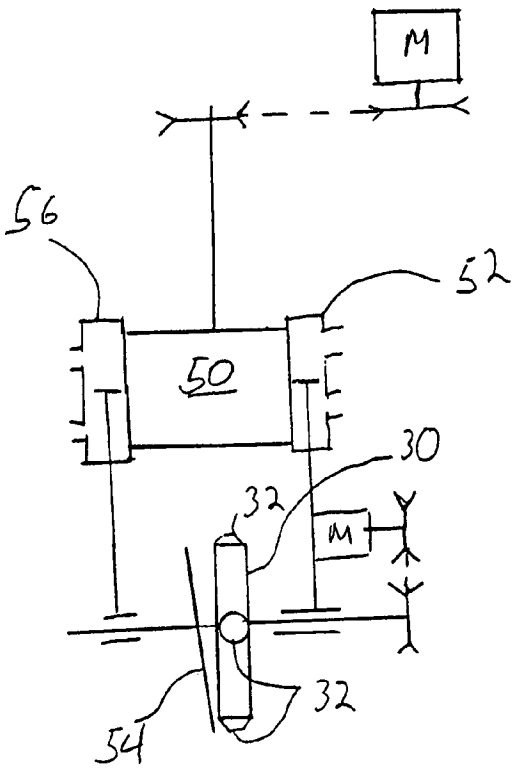
FIG. 7 schematically illustrates a rotary die, an edge cutting tool and a tool changer.

As shown schematically in FIG. 7, the present invention can also incorporate a tool changer 50 for storing several different cutting tools. During operation, when a different, or new cutting tool is required, the actuator 52 moves the rotary die 30 to the tool changer 50 where a mounted cutting tool is removed and stored, and a new or different cutting tool is installed. Also shown in FIG. 7 is a cutter 54 for cutting along pattern edges. In general the cutter 54 is round having a sharpened edge and is rotatable about an axis 55 that is generally coaxial with the axis 31 about which the rotary die 30 is rotatable. Both the rotary die and the cutter wheel are mountable via rotation of the housing 28, by the stepper motor 26, about the axis 29. During operation the cutter 54, in response to commands issued from the controller 21 engages the work material and is dragged via the movement of the carriage 18 and cutting head 20 along a cutting path. The actuator 56 moves the cutter 54 between the working and non-working positions.

Figure 9:
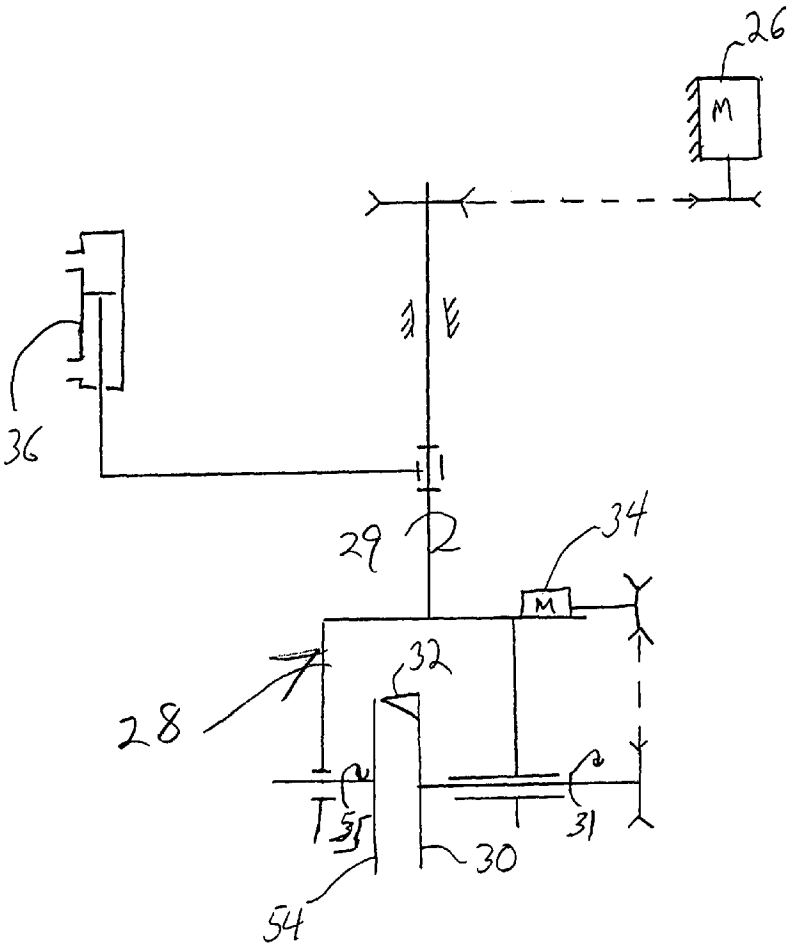
FIG. 9 schematically illustrates a rotary die and an edge cutting tool coupled to a cutting head forming part of the cutting table of FIG. 1.
Figure 8:
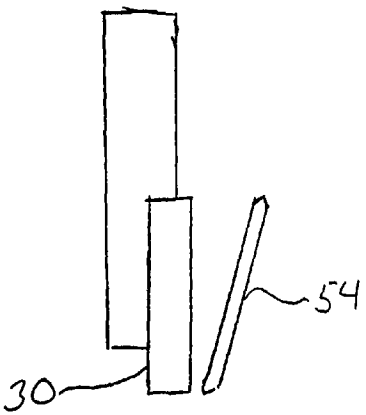
FIG. 8 schematically illustrates a rotary die and an edge cutting tool.

As shown schematically in FIGS. 8 and 9, the cutter 54 is positioned proximate the rotary die 30 so that during operation a continuous cut along a desired line of cut can be made while simultaneously cutting notches or other shaped apertures in the work material. This has the advantage of increasing throughput over prior art machines wherein notching and cutting are usually done as separate operations.

What is claimed is:

1. An apparatus for cutting pattern pieces and creating apertures in sheet-type work material, comprising:

a frame;

a support surface mounted on said frame for carrying at least one layer of sheet-type work material thereon, a carriage coupled to said frame for movement back-and-forth there along in a first coordinate direction in response to commands issued from a controller;

a cutting head mounted to said carriage for movement back-and-forth there along in a second coordinate direction generally perpendicular to said first coordinate direction in response to commands issued from said controller;

a rotary die rotatably coupled to said cutting head;

at least one cutting tool coupled to said rotary die, said cutting tool having a shaped cutting portion corresponding to the shape of an aperture to be formed in said work material;

said rotary die being movable between a working position wherein said at least one cutting tool engages said work material, and a non-working position wherein said rotary die is positioned away from said work material; and further comprising a cutter coupled to said cutting head for movement between a working position wherein said cutter engages said work material and a non-working position wherein said cutter is positioned away from said work material, and wherein said cutter is positioned adjacent to said rotary die when each is in said working position, thereby allowing pattern pieces to be simultaneously cut and notched in response to commands issued from said controller.

2. An apparatus as defined by claim 1 wherein said rotary die rolls about a first rotational axis and can be oriented by moving said rotary die about a second rotational axis approximately perpendicular to said first rotational axis.

3. An apparatus as defined by claim 1 further comprising:

a tool changer coupled to one of said frame, said carriage, and said cutting head, said tool changer being adapted to releasably carry at least one cutting tool;

said rotary die including carrying means for removing said at least one cutting tool from said tool changer and releasably retaining it thereon; and wherein said rotary die is selectively indexable relative to said tool changer so as to operably position said carrying means relative to said tool changer.

4. An apparatus as defined by claim 1 further comprising at least one drive means for moving said rotary die and said cutter between said working and said non-working positions.

5. An apparatus as defined by claim 4 wherein said at least one drive means includes first drive means coupled to and positioned between said rotary die and said cutter head for moving said rotary die between said working and non-working positions, and second drive means positioned between said cutter and said cutter head for moving said die cutter between said working and non-working positions.

6. An apparatus as defined by claim 5 wherein said first and second drive means can be simultaneously or independently actuated.

7. An apparatus as defined by claim 4 wherein said at least one drive means is a stepper motor.

8. An apparatus as defined by claim 4 wherein said at least one drive means is a pneumatic cylinder.

9. An apparatus as defined by claim 4 wherein said at least one drive means is a hydraulic cylinder.

10. An apparatus as defined by claim 1 wherein said cutter is a rotary die that defines a sharpened peripheral edge, said rotary die rotatably coupled to said cutting head.

11. An apparatus as defined by claim 10 wherein, said rotary die rolls about a first rotational axis and can be oriented by moving said rotary die about a second rotational axis approximately perpendicular to said first rotational axis, and said cutter rotates about a third rotational axis approximately coaxial with said first rotational axis and can also be oriented by rotation about said third rotational axis.

12. An apparatus as defined by claim 1 wherein:

a plurality of cutting tools are mounted on said rotary die and are spaced-apart from one another in a predetermined manner so that patterns of apertures can be cut during operation.

13. An apparatus as defined by claim 12 wherein said plurality of cutting tools are each pivotally coupled to said rotary die for movement between a cutting position wherein said cutting tool can operably engage said work material to cut an aperture therein, and a rotated position wherein said cutting tool cannot operably engage said work material.

14. An apparatus as defined by claim 13 wherein said rotary die includes a plurality of shaped recesses, at least a portion of which have one of said cutting tools pivotally mounted therein, and wherein an edge portion of said cutting tools abuts an edge defining said recess when said cutting tool is in said rotated position.

15. An apparatus as defined by claim 1 further comprising an actuator positioned between said rotary die and said cutting head for selectively indexing said rotary die to position a desired cutting tool mounted on said rotary die, in working proximity to said work material.

16. An apparatus as defined by claim 15 wherein said actuator is a stepper motor.

17. An actuator as defined by claim 15 wherein said actuator is a servo motor.

* * * * *

UNITED STATES PATENT AND TRADEMARK OFFICE

CERTIFICATE OF CORRECTION

PATENT NO. : 7,011,007 B2
APPLICATION NO. : 10/627003
DATED : March 14, 2006
INVENTOR(S) : Darryl C. Stein It is certified that error appears in the above-identified patent and that said Letters Patent is hereby corrected as shown below:

On the cover page
Section (75), Inventor, add:
--M. Shawn Cole, Tolland, CT (US)--.

On the cover page
Section (73), Assignee,
delete "Gerber Technology, Inc., Tolland, CT (US)" and insert --Gerber Scientific International, Inc., South Windsor, CT (US)--.

Signed and Sealed this

Second Day of January, 2007

JON W. DUDAS
*Director of the United States Patent and Trademark Office*